United States Patent [19]

Hotta

[11] 4,274,178

[45] Jun. 23, 1981

[54] DEVICE FOR STRIPPING A FIBROUS WEB FROM A DOFFER IN A CARDING MACHINE

[75] Inventor: Kyoichi Hotta, Nagoya, Japan

[73] Assignee: Kabushiki Kaisha Kyowa Kikai Seisakusho, Japan

[21] Appl. No.: 24,528

[22] Filed: Mar. 28, 1979

[51] Int. Cl.[3] ..... D01G 15/46

[52] U.S. Cl. ..... 19/106 R

[58] Field of Search ..... 19/106 R, 108, 109

[56] References Cited

U.S. PATENT DOCUMENTS

| | | | |
|---|---|---|---|
| 2,935,766 | 5/1960 | Lehman | 19/106 R |
| 2,987,779 | 6/1961 | Kawashima | 19/106 R |
| 3,256,569 | 6/1966 | Draving | 19/106 R |

*Primary Examiner*—Louis Rimrodt

*Attorney, Agent, or Firm*—Blair, Brown & Kreten

[57] ABSTRACT

A device for stripping a fibrous web from a doffer in a carding machine comprising a doffing roller for directly stripping the web from the doffer, a guide roller for guiding the web and a punched suction roller provided adjacent to the guide roller for feeding the web to a collector in combination with the guide roller. All the rollers are placed in mutually adjacent, parallel relation and are positively rotated. Within the punched roller, there is provided a stationary duct which is connected to a source of negative pressure. The duct includes an elongate suction port having a length corresponding to the effective length of the punched roller. The suction port faces the space between the punched roller and the guide roller. Air is drawn into the duct through a multiplicity of holes in the punched roller to prevent winding of the web around the doffing roller and the guide roller and remove waste fibers and impurities from the web.

6 Claims, 4 Drawing Figures

DEVICE FOR STRIPPING A FIBROUS WEB FROM A DOFFER IN A CARDING MACHINE

BACKGROUND OF THE INVENTION

1. Field of the Invention

The present invention relates to a device for stripping a fibrous web from a doffer in a carding machine for cotton and like materials, and more particularly, to a carded web stripping device having a suction roller which prevents winding of fibers around rollers and removes impurities from the web.

2. Description of the Prior Art

A fly comb has hitherto been well known in the art as a web stripping device on a carding machine. However, because of limitation of its speed in swinging movement, the fly comb cannot be applied to high-speed carding machines recently in use. Further, as such as fly comb strips the web by intermittent impacts during its swinging movement and causes a turbulence of air in its vicinity, it is difficult to obtain a satisfactory web having fibers disentangled and arranged in a parallel fashion.

To overcome such disadvantages of the fly comb, there has been provided a web stripping device in which a doffing roller having a mechanical stripping means such as a metallic wire in its periphery is provided adjacent a doffer and a plurality of rollers are placed between the doffer and a web collector. The rollers between the doffer and the web collector are, for example, a smooth roller or a roller having a relatively rough stripping means, depending on the purpose of the device. However, a stripping device of this type is complicated in construction and requires a wide space for accommodation of the rollers. Further, as the speed of rotation of the roller having the stripping means is increased, stripping of the web from the roller becomes difficult and fibers are wound around the roller, whereby much time is required for cleaning the roller to remove the fibers. If the web which is a thin flat mass of disentangled fibers, is strained to prevent winding of the fibers around the roller, its feeble edges are unduly stretched when it is pulled by the collector. Another disadvantage of the device is that it takes much time in the beginning of the operation to adjust the velocity ratio between the rollers and to feed the web successively through the rollers. Further, the waste fibers and impurities once separated from the web tend to stick again to the web under the influence of a revolving air flow created by rotation of the rollers and lower the quality of the sliver produced from the web.

SUMMARY OF THE INVENTION

The present invention contemplates overcoming the aforementioned disadvantages of the conventional web stripping device.

An object of the present invention is to provide a device for stripping a web from a doffer in a carding machine which is simple in construction, space saving and reliable in operation.

Another object of the present invention is to provide a device for stripping a web from a doffer in a carding machine wherein the web or fibers are effectively prevented from winding around rollers used therein.

Still another object of the present invention is to provide a device for stripping a web from a doffer in a carding machine including a suction means for effectively removing waste fibers and impurities from the web.

A further object of the present invention is to provide a device for stripping a web from a doffer in a carding machine wherein an evenly carded web is obtained to be formed by a collector into a sliver.

A still further object of the present invention is to provide a device for stripping a web from a doffer in a carding machine wherein the suction port of a suction means is designed to maintain a substantially equal suction force with respect to the width of the web.

The device of the present invention comprises a doffing roller mounted in adjacent, parallel relation to a doffer and provided around its periphery with a mechanical stripping means having an effective width substantially equal to the effective length of the doffer, the doffing roller being adapted to be positively rotated in the same direction as the doffer for stripping a web from the doffer; a guide roller provided under the doffing roller in parallel thereto and adapted to be positively rotated in a direction opposite to the doffing roller for guiding the stripped web along its surface; and a suction roller provided adjacent to the guide roller in parallel with the guide roller and the doffing roller. The suction roller comprises a punched roller having a multiplicity of holes formed through its cylindrical wall and adapted to be positively rotated in the same direction with the doffer, and a stationary duct extending longitudinally within the punched roller and having an elongate suction port facing the guide roller. The suction port extends along the entire effective length of the punched roller. The duct is in contact with the inner surface of the punched roller at least in its portion defining the suction port. The duct draws through its suction port waste fibers and impurities to remove them from the web passing between the punched roller and the guide roller. All the rollers are appropriately arranged to strip a web from the doffer and properly guide it through the device. The duct is connected to a source of negative pressure for drawing air into the duct.

The duct has a longitudinal slit tapered toward the negative pressure source and which defines the suction port which draws air through the holes in the punched roller. Under the guide roller, there is provided a generally upright wall to prevent occurrence of a revolving air current subsequent to rotation of the guide roller and thereby prevent winding of fibers around the guide roller.

Thus, the device of the present invention has only three rollers positioned adjacent to one another and which require only a narrow space for installation. Especially the suction roller is compact in construction and since its suction port faces the guide roller and the doffing roller, a current of air drawn through the suction port prevents winding of a web around any of the rollers and insures proper guiding of the web, thereby raising the operating speed of the device and increasing the production efficiency of a carding machine with which the present device is associated. The air drawn through the suction port effectively removes waste fibers and impurities so that a sliver of improved quality may be obtained.

DESCRIPTION OF THE PREFERRED EMBODIMENT

Figure 1:
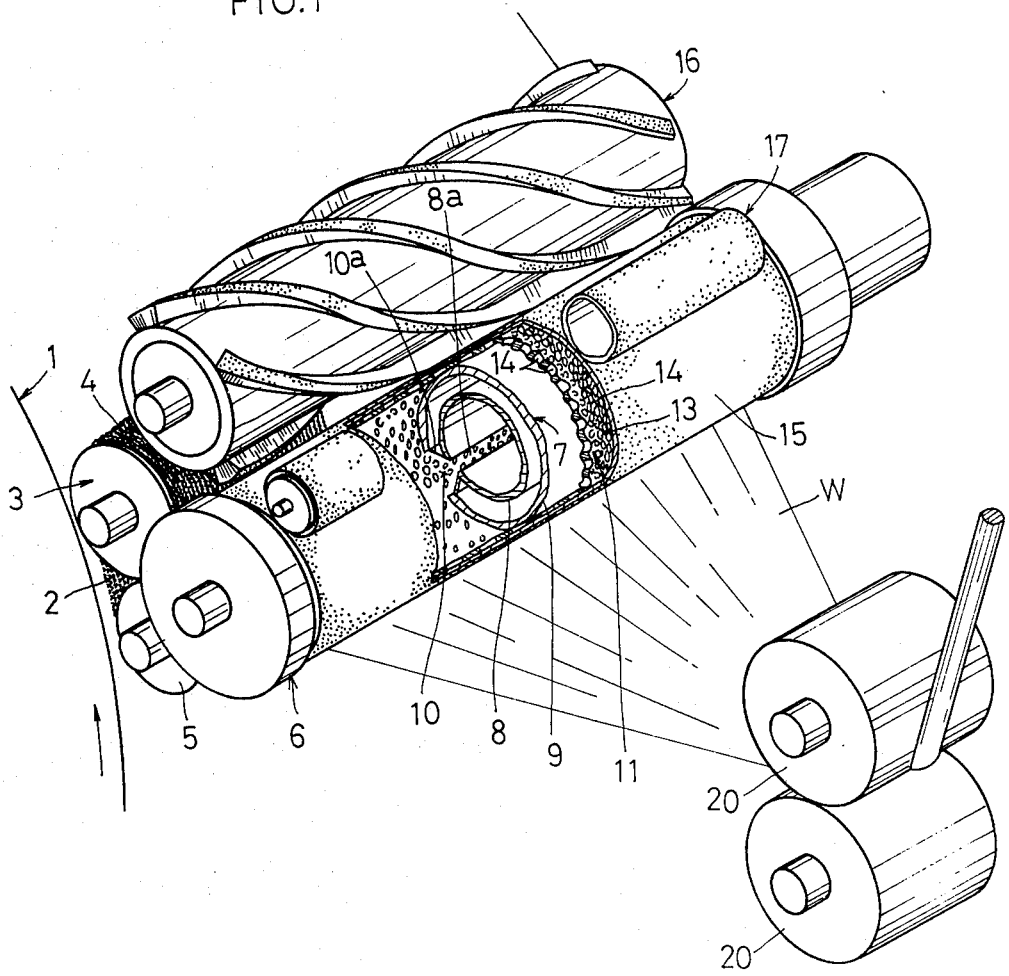
FIG. 1 is a perspective view, partly in section, of a web stripping device embodying the present invention.
Figure 2:
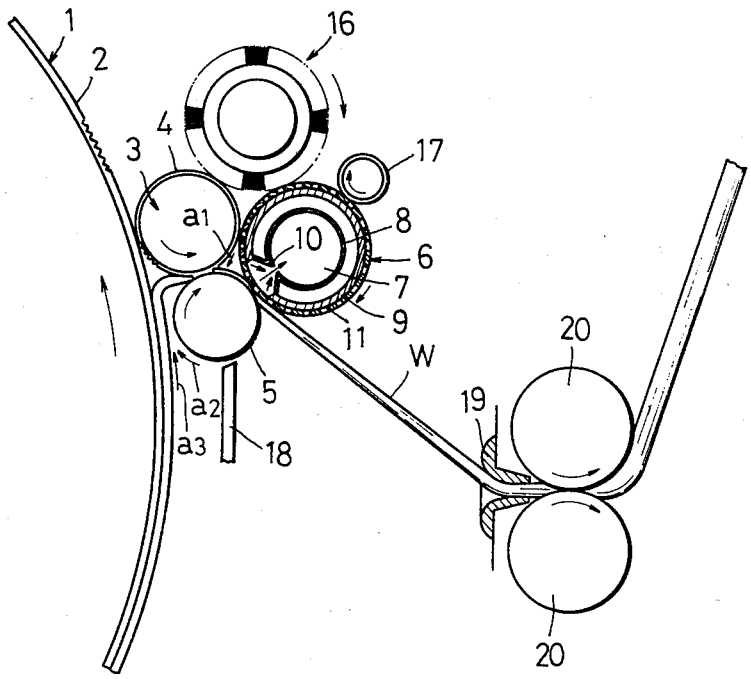
FIG. 2 is a vertical cross sectional view on a somewhat reduced scale of the device shown in FIG. 1.
Figure 3:
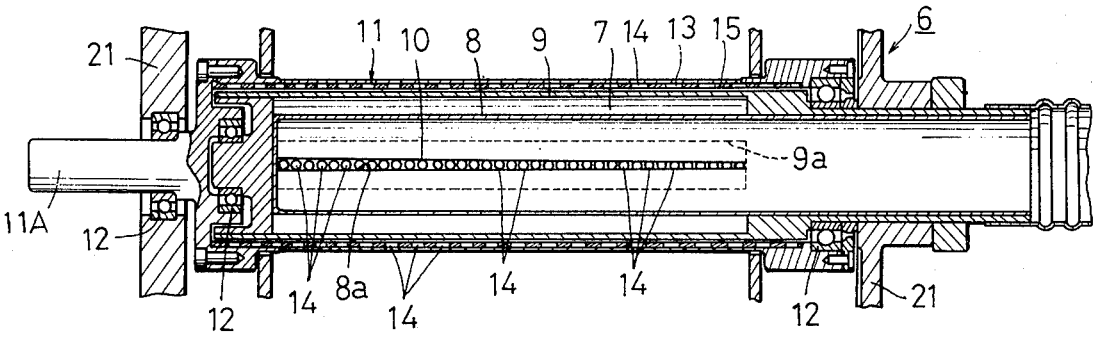
FIG. 3 is a longitudinal cross sectional view of the suction roller shown in FIG. 1.

Referring now to FIGS. 1 to 3 of the drawings, a conventional carding cloth 2 is wound around a doffer 1 which is positively rotated in the counter-clockwise direction as viewed in FIG. 2. A doffing roller 3 having a substantially identical effective length with the doffer 1 and about which a metallic wire 4 is wound is placed adjacent to the doffer 1 in closely spaced, parallel relationship thereto with a clearance of about 0.1 to 0.3 mm between the carding cloth 2 and the metallic wire 4. The doffing roller 3 is positively rotated 1.05 to 1.20 times faster in peripheral velocity than the doffer 1 in the counter-clockwise direction as viewed in FIG. 2.

A guide roller 5 is positioned under the doffing roller 3 in closely spaced, parallel relationship thereto with a clearance of about 0.2 to 1.5 mm between its peripheral surface and the metallic wire 4 on the doffing roller 3. The guide roller 5 is also substantially identical in effective length with the doffer 1, and is positively rotated 0.60 to 1.40 times faster in peripheral velocity than the doffer 1 in the clockwise direction as viewed in FIG. 2. The outer periphery of the guide roller 5 is normally plated with hard chromium to give a smooth surface.

A suction roller 6, which forms an important part of the device of the present invention, is provided in closely spaced, parallel relationship to the doffing roller 3 and the guide roller 5, and has a stationary duct 7 therein. As shown in FIG. 3, the duct 7 comprises a cylindrical inner tube 8 and a cylindrical outer tube 9 coaxially encircling the inner tube 8. The outer tube 9 is sealed against the inner tube 8 at the both ends thereof. The rear end of the inner tube 8 as shown on the right-hand side of FIG. 3 is extended beyond the suction roller 6 and connected to a negative pressure source (not shown) having suction capacity of about 3 to 5 $m^3$/min.

The inner tube 8 has in its periphery a longitudinal slit 8*a* having a generally V-shaped cross section and tapered toward the negative pressure source as best shown in FIG. 3, while the outer tube 9 is formed longitudinally with a rectangular slit 9*a* as shown in broken lines in FIG. 3. The slit 9*a* is located immediately radially outwardly of the slit 8*a* and has a longer width than the slit 8*a* as it approaches the rear end of the suction roller 6. The longitudinal edges of the slits 8*a* and 9*a* are connected with each other by a pair of longitudinal side plates 10*a* defining therebetween an elongate suction port 10 which is substantially V-shaped in transverse section (see FIG. 2). The purpose of gradually increasing the width of the slit 8*a* toward the front end of the inner tube 8 is to permit the suction port 10 to maintain a substantially equal suction force throughout its entire length.

The outer periphery of the suction roller 6 is formed by a punched roller 11 having a multiplicity of small holes. The punched roller 11 is mounted by bearings 12 on bosses provided at both ends of the outer tube 9 and coaxially encircles the outer tube 9 including its portion in which the suction port 10 is provided. The punched roller 11 is rotatable about the outer tube 9 substantially in close contact therewith. The punched roller 11 comprises a hollow roller 13 provided with a multiplicity of holes 14, and a stainless steel sheet 15 placed about the hollow roller 13 and provided with a multiplicity of holes each having a diameter of about 0.5 mm. The holes 14 are preferably provided in as close proximity to one another as practically possible. The holes of the stainless steel sheet 15 may have a total open area which occupies about 35% of the total surface area of the sheet 15. The punched roller 11 is substantially equal to the doffer 1 in effective length. The holes in the stainless steel sheet 15 are each sized to permit waste fibers and fine impurities derived from a web W to flow out therethrough on an air stream forced through the suction roller 6. The punched roller 11 is positively rotated 1.00 to 1.40 times faster in peripheral velocity than the doffer 1 in the counter-clockwise direction as viewed in FIG. 2 via a drive shaft 11A (FIG. 3) fixed to the front end of the hollow roller 13.

The suction roller 6 is rotatably supported by a pair of end frames 21 adjacent to the doffing roller 3 and the guide roller 5. There is a clearance of about 1.0 to 3.0 mm between the punched roller 11 and the metallic wire 4 on the doffing roller 3. There is a clearance of about 0.5 to 3.0 mm between the punched roller 11 and the guide roller 5. The suction port 10 of the duct 7 faces the doffing roller 3 and the guide roller 5, and preferably, it has a longitudinal center line lying approximately in a plane in which the longitudinal axes of the guide roller 5 and the suction roller 6 are located. The suction port 10 must be appropriately positioned and oriented when the device is placed in operation.

A cylindrical brush 16 is provided in so close contact with the doffing roller 3 and the punched roller 11 that its bristles may have a rubbing depth of about 0.3 to 1.0 mm against rollers 3 and 11. The cylindrical brush 16 is positively rotated at least 1.2 times faster in peripheral velocity than the doffing roller 3 in the clockwise direction as viewed in FIG. 2. The cylindrical brush 16 is substantially equal in effective length to the doffing roller 3 and the punched roller 11. A small diameter cylindrical gleaning brush 17 is in frictional contact with the punched roller 11 for rotation therewith in the opposite direction. The gleaning brush 17 is substantially equal to the punched roller 11 in effective length.

A generally upright wall 18 is provided under the guide roller 5 and has an upper edge positioned close to the guide roller 5 to prevent occurrence of a concomitant air current subsequent to rotation of the guide roller 5.

A web collector 19 is provided forwardly and downwardly of the suction roller 6, and a pair of calender rollers 20 are placed forwardly of the collector 19 to be positively rotated 1.2 to 1.4 times faster in peripheral velocity than the doffer 1 to draw a web W out through the collector 19.

In operation, a web W is supplied to the device of the present invention along the carding cloth 2 of the doffer 1, and stripped from the doffer 1 by the metallic wire 4 of the doffing roller 3. Then the web W passes between the doffing roller 3 and the guide roller 5 and is exposed to the suction force of the suction roller 6 acting in the direction indicated by an arrow A in FIG. 2. Since air flows down through the space between the doffing roller 3 and the punched roller 11 in the direction indicated by an arrow $a_1$ in FIG. 2, the web W does not stick to the doffing roller 3, but is guided along a proper path between the guide roller 5 and the suction roller 6. However, waste fibers and impurities tending to stick to the doffing roller 3 are drawn through the holes of the punched roller 11 and the duct 7 into the negative pressure source and removed. Further, waste fibers tending to stick to the guide roller 5 are also drawn by the suction roller 6 and removed. Thus, the suction roller 6 functions to insure proper guiding of the web W and remove waste fibers and impurities therefrom.

Thereafter, the web W is properly guided without winding around the guide roller 5 by virtue of the functions of the suction roller 6 and the wall 18 as it is drawn by the calender rollers 20, and is collected by the collector 19 into a reduced width to form a sliver. Since the web W leaving the doffing roller 3 is pressed between the guide roller 5 and the punched roller 11 when traveling therebetween, the action of the collector 19 does not reach the doffing roller 3. In other words, the web W can maintain its full width extending over the entire effective length of the doffing roller 3 when moving past the doffing roller 3. Thus, the web W will not be entangled with the metallic wire 4 and torn, nor will it become defective in any other way that may cause trouble in the subsequent spinning operation.

The cylindrical brush 16 functions to remove any waste fibers and impurities from the doffing roller 3 and the punched roller 11 if any should remain on the surfaces thereof. It is particularly effective in removing impurities, such as stalks and fructifications. The gleaning brush 17 functions to clean the outer surface of the punched roller 11.

Figure 4:
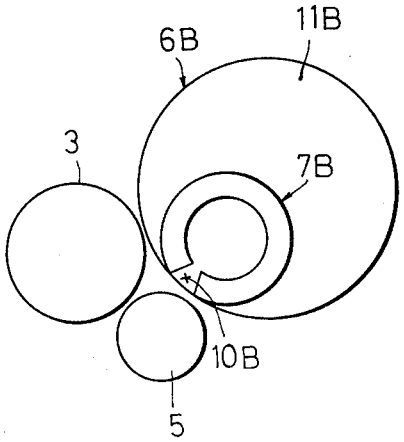
FIG. 4 is a diagrammatical cross sectional view showing a different suction roller.

FIG. 4 schematically shows a different form of suction roller 6B. It has a duct 7B eccentrically positioned in a punched roller 11B and having a considerably smaller diameter than the punched roller 11B. The duct 7B has a suction port 10B positioned relative to the doffing roller 3 and the guide roller 5 in a similar fashion to the suction port 10 of FIG. 2. The longitudinal configuration of the suction port 10B is identical with that of the suction port 10 so that a substantially equal suction force may be maintained throughout the entire length of the suction port 10B.

While the invention has been described with reference to a preferred embodiment thereof, it is to be understood that modifications or variations may be easily made without departing from the scope of this invention which is defined by the appended claims. For example, the sizes of the clearances between the various rollers, the degree of the negative pressure to draw air through the suction roller and the speeds of rotation of the various rollers must be changed to suit the type of the fibers to be processed and the specific conditions of a spinning operation.

What is claimed is:

1. A device for stripping a fibrous web from a doffer in a carding machine, said device comprising:

a doffing roller having in its periphery a mechanical stripping means corresponding in width with said doffer, said doffing roller being provided adjacent to and in parallel with said doffer to be positively rotated in the same direction as said doffer for stripping said web from said doffer;

a guide roller provided under said doffing roller in parallel with said doffer and adapted to be positively rotated in a direction opposite to the direction of rotation of said doffing roller for guiding said web along its surface as said web is stripped from said doffer;

a suction roller provided adjacent to said guide roller in parallel with said doffing roller on the side of said doffing roller and said guide roller opposite said doffer, said suction roller having a porous punched roller positively rotated in the same direction with said doffer, and a stationary duct extending longitudinally within said punched roller, said duct having an elongate suction port facing said guide roller and extending along the entire effective length of said punched roller, said suction port being located immediately inwardly of the inner surface of said punched roller; and a source of negative pressure connected with said duct for drawing air from the vicinity of said doffing and guide rollers into said duct through said suction port.

2. The device as defined in claim 1 wherein said stationary duct comprises an inner tube which is coaxial with said punched roller and an outer tube coaxially encircling said inner tube and contacting the inner surface of said punched roller, said inner tube having a longitudinal slit tapered toward said negative pressure source and said outer tube having a longitudinally extending rectangular slit which is larger in width than said slit of said inner tube, said slits being connected with each other by a pair of longitudinal side plates defining therebetween said suction port which is substantially V-shaped in cross section.

3. The device as defined in claim 1 wherein said stationary duct is a cylinder eccentrically placed relative to said punched roller, and said suction port is defined by an inner longitudinal slit tapered toward said negative pressure source, a longitudinally extending rectangular outer slit and a pair of side plates extending longitudinally of said slits, said duct contacting the inner surface of said punched roller in its portion in which said outer slit is provided, said suction port being substantially V-shaped in cross section.

4. The device as defined in claim 1 further comprising a cylindrical brush positively rotated in contact with said doffing roller and said suction roller and a gleaning brush placed in frictional contact with said suction roller.

5. The device as defined in claim 1 wherein said guide roller has a smooth outer peripheral surface coated with hard chromium, and said device further comprising a wall provided under said guide roller for preventing a concomitant revolving flow of air upon rotation of said guide roller.

6. The device as defined in claim 1 wherein said punched roller comprises a hollow roller having a plurality of holes and a stainless steel sheet placed on said hollow roller and provided with a plurality of holes each having a diameter of about 0.5 mm and which have a total open area occupying about 35% of the total surface area of said sheet.

* * * * *